US009604207B2

(12) United States Patent
Izumo et al.

(10) Patent No.: US 9,604,207 B2
(45) Date of Patent: Mar. 28, 2017

(54) PIPETTE DEVICE

(71) Applicant: A&D Company, Limited, Tokyo (JP)

(72) Inventors: Naoto Izumo, Saitama (JP); Yutaka Dodate, Saitama (JP)

(73) Assignee: A&D COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/785,469

(22) PCT Filed: May 14, 2013

(86) PCT No.: PCT/JP2013/063392

§ 371 (c)(1),
(2) Date: Oct. 19, 2015

(87) PCT Pub. No.: WO2014/184865

PCT Pub. Date: Nov. 20, 2014

(65) Prior Publication Data

US 2016/0082430 A1 Mar. 24, 2016

(51) Int. Cl.
*B01L 3/02* (2006.01)

(52) U.S. Cl.
CPC ..... *B01L 3/0237* (2013.01); *B01L 3/0217* (2013.01); *B01L 3/0286* (2013.01); *B01L 2200/08* (2013.01)

(58) Field of Classification Search
None
See application file for complete search history.

(56) References Cited

U.S. PATENT DOCUMENTS 4,968,486 A 11/1990 Zander
5,892,161 A * 4/1999 Conley ..... B01L 3/0227 73/864.18
6,299,841 B1 * 10/2001 Rainin ..... B01L 3/0227 422/518

(Continued)

FOREIGN PATENT DOCUMENTS

DE 10 2005 034 963 A1 1/2007
JP 2007316074 A 6/2007

(Continued)

OTHER PUBLICATIONS

International Search Report for Application No. PCT/JP2013/063392 dated Aug. 30, 2013.

(Continued)

*Primary Examiner* — Jill Warden
*Assistant Examiner* — Brittany Fisher
(74) *Attorney, Agent, or Firm* — Roberts Mlotkowski Safran Cole & Calderon P.C.

(57) ABSTRACT

To provide an electric pipette in which the impact resistance against the dropping of the electric pipette is elevated, the external breakage of the device and the damage of operation performances are reduced, and the discharging performance of the device is maintained and ensured. An electric pipette 100 including a main casing 1, an operation switch 14, a hand grip 15, a display-operation section 9, a release switch 12 and a finger rest 16, in which at least one shock absorber 201 to 206 disposed on at least one apex of at least one line among a line LF, a line LB, a line LL, a line LR and a line LU, which are prepared by drawing lines between two or more projecting sites in each of a front surface 100F, a back surface 100B, a left side surface 100L, a right side surface 100R and an upper surface 100U.

6 Claims, 4 Drawing Sheets

(56) References Cited

U.S. PATENT DOCUMENTS

| | | | | |
|---|---|---|---|---|
| 2002/0012613 | A1 | 1/2002 | Scordato et al. | |
| 2007/0283743 | A1* | 12/2007 | Telimaa | B01L 3/0217 73/1.74 |
| 2008/0034898 | A1* | 2/2008 | Molitor | B01L 3/0227 73/864.16 |
| 2009/0071266 | A1* | 3/2009 | Nelson | B01L 3/0234 73/864.11 |
| 2009/0074622 | A1* | 3/2009 | Kalamakis | B01L 3/0217 422/400 |
| 2009/0117008 | A1* | 5/2009 | Lind | B01L 3/0227 422/400 |
| 2010/0132486 | A1* | 6/2010 | Millet | B01L 3/0227 73/864.13 |
| 2012/0201722 | A1 | 8/2012 | Telimaa et al. | |
| 2012/0291567 | A1* | 11/2012 | Homberg | B01L 3/0237 73/864.13 |

FOREIGN PATENT DOCUMENTS

| | | | |
|---|---|---|---|
| JP | 2008039785 | A | 2/2008 |
| JP | 2010227933 | A | 10/2010 |
| JP | 5791852 | B | 8/2015 |

OTHER PUBLICATIONS

Henry I. Kohn and Frederick Bernheim With the Technical Assistance of Anton V. Felsovanyi, The Blood V-Factor (Coenzyme) Level in the Normal and Pathological Subjects, From the Department of Physiology and Phyarmacology, Duke University School of Medicine, Durham, Received for Publication May 10, 1939, p. 585-591.

Softgrip Pipette Catalog, User-Centric Designs That Maximize Quality, Comfort and Precision, Hamilton, p. 1-18.

* cited by examiner

PIPETTE DEVICE

TECHNICAL FIELD

The present invention relates to a manually and individually operable micropipette, and, more in detail, to an electrically operable micropipette.

BACKGROUND ART

As described in Patent Publication 1, for example, an electrically operable micropipette (hereinafter referred to as "electrical pipette") includes, in a vertically long cylindrical main casing, a motor and a cylinder into which a piston is inserted. The driving of the motor which is activated by means of an operation switch disposed in the main casing while a handgrip of the main casing is gripped vertically moves the piston in the cylinder. The vertical movement makes positive and negative pressures in the cylinder to suck and discharge a predetermined amount of liquid into and from a chip equipped at the front end of the main casing.

In order to perform the sucking and discharging operations, a display-operation section is disposed at the base end of the main casing to establish a volume parameter and an operation mode of the device. At the base end of the main case in which the display-operation section is positioned, an electric board for electrically controlling the motor depending on the respective setups of the display-operation section, and an electric source for driving the electric board and the motor are disposed. Further, a release switch for detaching the chip and a finger rest acting as a holding assist during an operation and a stopper during a non-operation are disposed in the main casing.

PRIOR TECHNICAL PUBLICATIONS

Patent Publications

Patent Publication 1: JP-A-2008-39785

SUMMARY OF INVENTION

Problems to Be Solved By Invention

A user of the above electric pipette repeats pipetting operations for a loner period time in every aspect so that the electric pipette may be sometimes dropped on a floor during the operation. The electric pipette which is small enough to be handheld may be accidentally dropped from an operation table. However, problematically, a conventional electric pipette described in Patent Publication 1 is not equipped with a means of taking measures against the impact of the dropping.

When the breakage by the dropping is externally unrecoverable such as a crack, a chap and a disabling condition, its unavailability is apparent. On the other hand, a severe problem arises when the breakage does not appear externally and is an internal damage and the operation can be seemingly continued. In this case, the judgment is difficult whether the operation accuracy is secured or not. Although an inspection of the discharging performance of the pipette can check the correctness of the judgment, the inspection requires a dedicated inspection device, a length of time and a certain amount of cost so that the inspection should be avoided as much as possible.

The present invention has been made based on the problem of the conventional art, and an object thereof is to provide an electric pipette in which the impact resistance against the dropping of the electric pipette is elevated, the external breakage of the device and the damage of operation performances are reduced, and the discharging performance of the device is maintained and ensured.

Means of Solving Problems

An electric pipette in accordance with claim 1 for achieving the above object has the configuration of a vertically cylindrical main casing including a liquid sucking and discharging mechanism for sucking and discharging a liquid by vertically moving a piston in a cylinder, and a chip which is detachably positioned on a front end of the mechanism constituting a lower side, and is in communication with the mechanism, an operation switch for activating the mechanism, a hand grip of the main casing which is gripped when the operation switch is operated, a display-operation section for establishing a sucking and discharging movement, a release switch for detaching the chip, a finger rest acing as a support assistance during an operation and as a stopper during a non-operation, and a shock absorber disposed on at least one apex of at least one line among a front surface line, a back surface line, a left side surface line, a right side surface line and an upper surface line, which are prepared by drawing lines between two or more projecting sites in each of a front surface, a back surface, a left side surface, a right side surface and an upper surface appearing on an external shape of the electric pipette designed to include above constituents.

In accordance with the electric pipette of claim 2, the display-operation section is designed to exist on a base section of the main casing, and the shock absorber is disposed on the upper surface of the electric pipette of claim 1.

In accordance with the electric pipette of claim 3, the shock absorber is disposed on an outer periphery of an bottom end of the handgrip in the electric pipette of claim 1 or 2.

In accordance with the electric pipette of claim 4, the display-operation section is designed to exist on the front surface of the electric pipette, the release switch is designed to exist on the front surface of the electric pipette, and the shock absorber is disposed on an upper surface of the release switch in one of claims 1 to 3.

In accordance with the electric pipette of claim 5, the display-operation section is designed to exist on the front surface of the electric pipette, the finger rest is designed to exist on the back surface of the pipette, and the shock absorber is disposed on a bottom surface of the finger rest in one of claims 1 to 4.

In accordance with the electric pipette of claim 6, projecting charging points positioned on the left and right side surfaces, which are in electrical communication with a rechargeable battery stored in the main casing, are formed. and the shock absorbers are disposed on the left and right side surfaces, which exist more externally than the charging points in a horizontal direction in any one of claims 3 to 5.

Effects of Invention

In accordance with the present invention, the external destruction of the electric pipette and the damage of the operation environment can be reduced by disposing the shock absorbers at the respective convex positions on the external shape of the electric pipette, that is, at, at least one apex on, at least one dropping predicted line, which is anticipated to be in contact with the floor when the electric pipette is dropped, because the impact against the article dropping can be reduced. Further, the units, such as the motor in the electric pipette and the electric board for controlling the motor, which are easily damaged due to the impact can be also protected so that the discharging function of the pipette can be secured and maintained, and the device reliability is also increased.

In consideration of the disposition of a weighed article above the main case of the electric pipette, the shock absorber may be disposed not only at the apex but also on the entire upper surface so that the impact resistance is further elevated.

Since the detachable soft chip is equipped at the lower part (front end) of the electric pipette, the impact resistance is further elevated by disposing the shock absorber on the entire region of the handgrip which to be protected when the chip is detached.

The operating ability by means of the anti-slip effect of the finger and the fitting comfort can be elevated by disposing the shock absorbers on the apexes of the front surface line and the back surface line of the release switch and the finger rest and, in addition, on the upper surface of the release switch and the lower surface of the finger rest on which the finger of the user is contacted.

When a battery is employed as a power source of the electric pipette, a charge point is required for electrically connecting an external charging device with the battery. The impact resistance is further elevated by disposing the shock absorber which is taller than the charging point on the surface on which the charging point is disposed for preventing the destruction of the charging point.

EMBODIMENTS FOR IMPLEMENTING INVENTION

Figure 1:
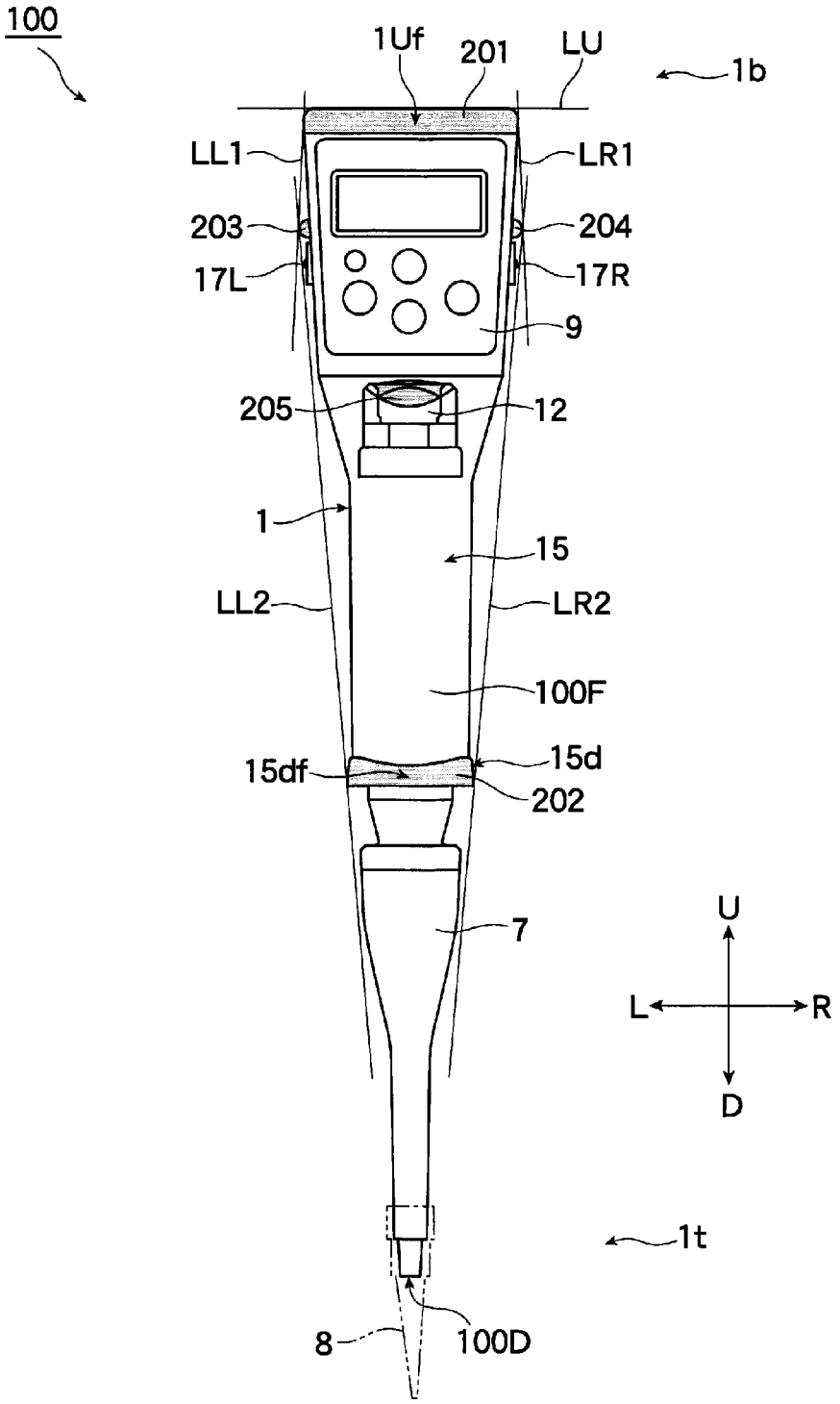
FIG. 1 A front elevational view of an electric pipette in accordance with an embodiment of the present invention.
Figure 2:
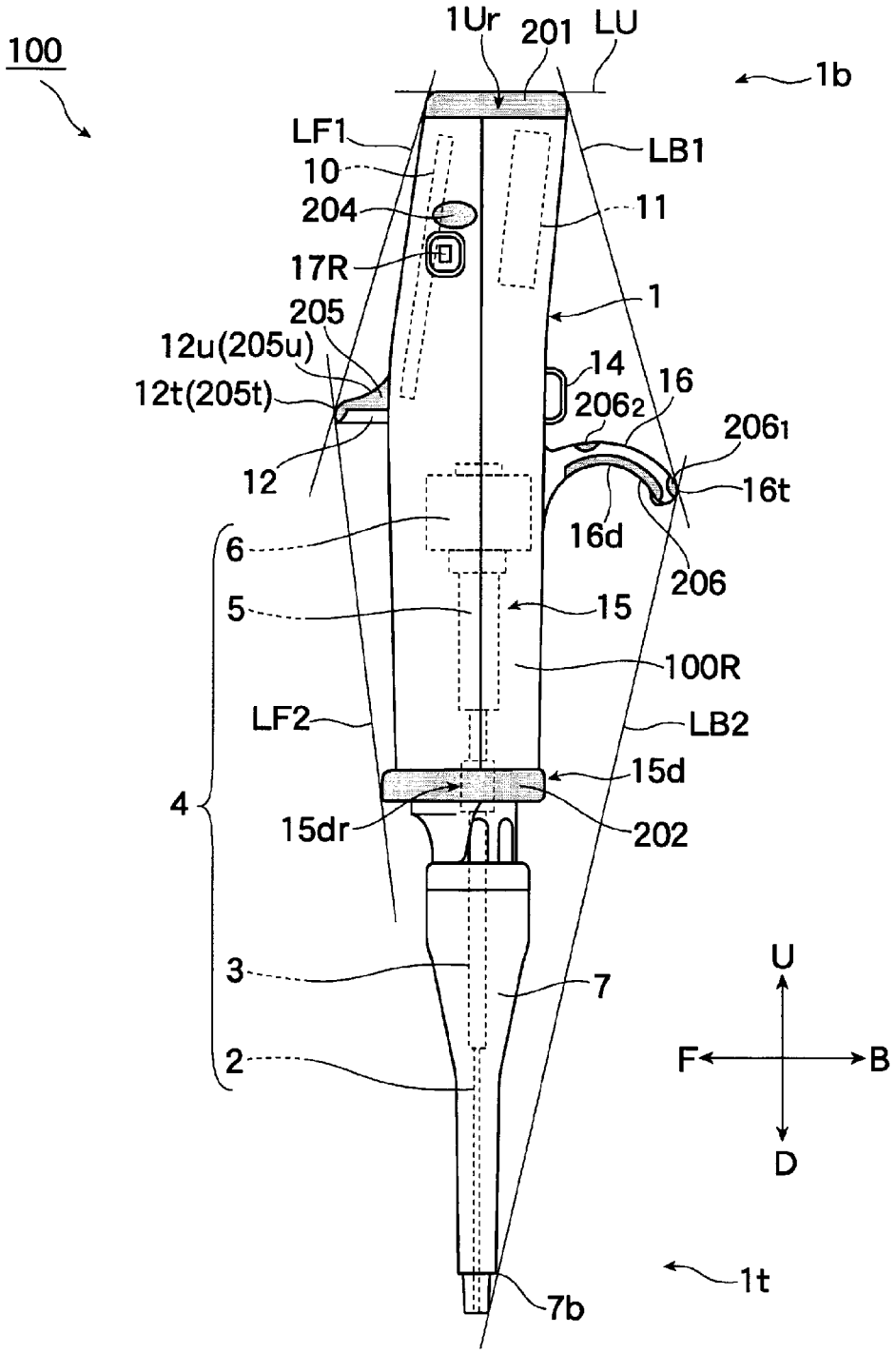
FIG. 2 A right side view of the electric pipette.
Figure 3:
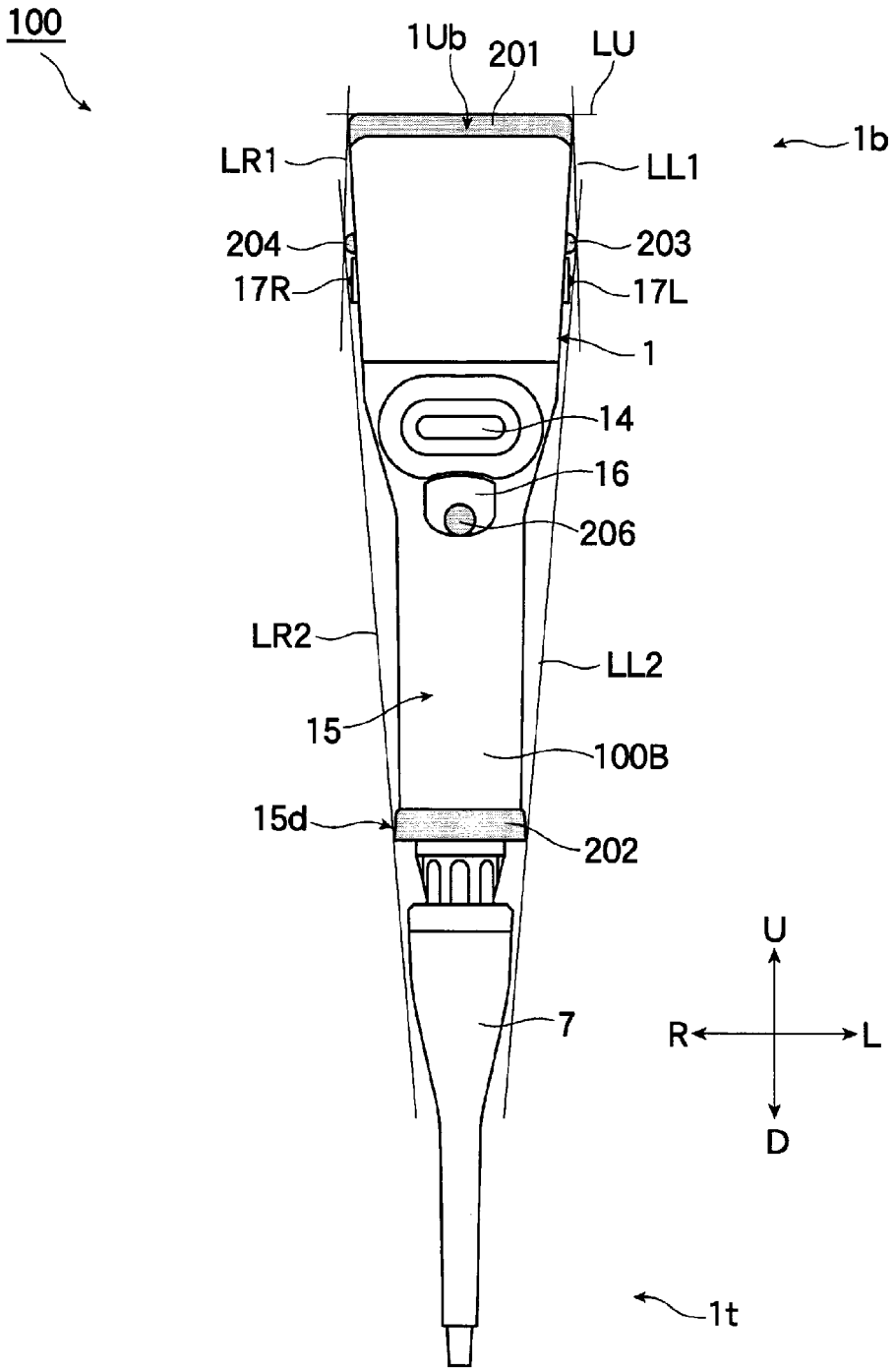
FIG. 3 A rear view of the electric pipette.
Figure 4:
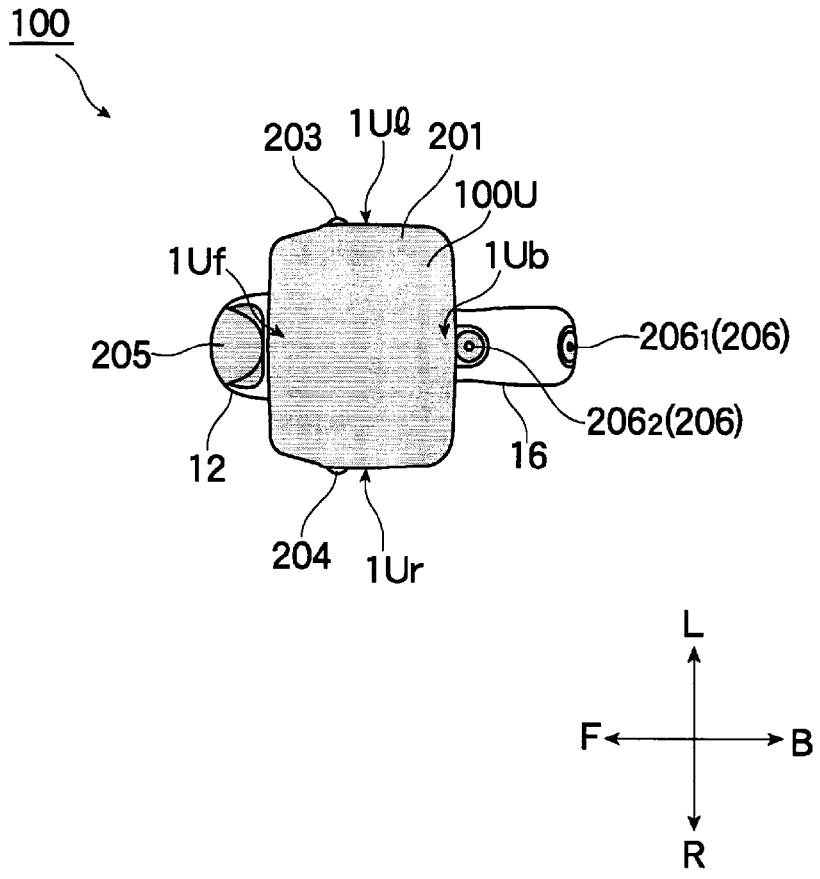
FIG. 4 A plan view of the electric pipette.

The embodiments of the present invention will be described in detail referring to the drawings. FIG. 1 is a front elevational view of an electric pipette in accordance with an embodiment of the present invention, FIG. 2 is a right side view of the electric pipette, FIG. 3 is a rear view of the electric pipette, and FIG. 4 is a plan view of the electric pipette. Symbols "U" and "D" in the drawings designate an upward direction and a downward direction of the pipette, respectively. Symbols "L" and "R" in the drawings designate a leftward direction and a rightward direction of the pipette, respectively. Symbols "F" and "B" in the drawings designate a forward direction and a backward direction of the pipette, respectively.

A symbol 100 denotes an electric pipette in accordance with the embodiment of the present invention which is a manually and individually operable micropipette having an entire length of about 280 mm. A symbol 1 denotes a vertically cylindrical main casing which is formed by combing a front casing and a rear casing, and a liquid sucking and discharging mechanism 4 is accommodated in the main casing. The mechanism 4 includes a cylinder 2 which sucks and discharges a liquid, a piston 3 which reciprocally moves in a vertical direction in the cylinder 2, a ball screw mechanism 5 which is connected to the piston 3 and vertically moves the piston 3, and a motor 6 which is positioned above the ball screw mechanism 5 and rotatably drives a ball screw in forward and reverse directions.

A symbol 7 denotes a chip holder which constitutes a part of the main casing 1 and is detachably engaged with a bottom part of the main casing 1. For the assembling, the bottom part of the cylinder 2 which is tapered toward the downward direction is accommodated. A chip 8 (shown in FIG. 1 with broken lines) is detachably equipped at the bottom part of the chip holder 7 such that the chip is inserted into the bottom end of the cylinder 2. The side to which the chip 8 is equipped, that is, the downward direction of the main casing 1 will be referred to as a front end of the main casing 1, and an upward direction of the main casing 1 will be referred to as a base end of the main casing 1.

Above the front surface (main surface) 100F of the electric pipette 100 is disposed a display-operation section 9 employing a liquid crystal panel which can establish sucking and discharging performances of the liquid so that a parameter for a discharging amount and an operation mode of a device can be set up. In the rear part of the display-operation section 9 of the main casing 1 are accommodated an electric board 10 for electrically controlling the motor 6 depending on the respective setups of the display-operation section 9, and an electric source 11 positioned above the motor 6 for driving the electric board 10 and the motor 6.

A release switch 12 is disposed below the display-operation section 9 for detaching the chip 8. This release switch 12 disposed on the front surface 100F of the pipette is mechanistically communicated with the chip holder 7, and the chip 8 is pushed down by pressing the release switch 12 toward the downward direction, and is detached from the chip holder 7. The release switch 12 is formed in a button shape forwardly projecting from the electric pipette 100 such that the push-down operation by a user is easily performed.

An operation switch 14 for activating the liquid sucking and discharging mechanism 4 is disposed near the center of the back surface (rear surface) 100B of the electric pipette 100. When the operation switch 14 is pushed inwardly toward the casing, the motor 6 is driven to rotate the ball screw 5 for vertically moving the piston 3 in the cylinder 2. This movement makes positive and negative pressures in the cylinder 2 for sucking and discharging a predetermined amount of liquid through the chip 8 at the display-operation section 9.

A user operates the release switch 12 and the operation switch 14 by using the thumb and the forefinger, respectively, for operating the electric pipette 100 so that a handgrip 15 which is gripped during the operation is formed on the main casing 1 below the display-operation section 9 and below the release switch 12 and the operation switch 14.

A finger rest 16 is formed on the back surface 100B of the pipette below the operation switch 14 acting as a support assistance during the operation and a stopper during the non-operation. The finger rest 16 projects toward the rear direction from the electric pipette 100 and is hook-shaped bending toward the downward direction such that the fingers other than the finger operating the operation switch 14 are easily hooked to the finger rest 16 when the user grips the finger rest 16.

The above configuration is known also in a design of a conventional electric pipette. The electric pipette different from box-shaped ordinary measuring devices is thin and small in size for portability and includes a convexoconcave intended for the operation by using the thumb and the forefinger so that the shock-absorbing structure is difficult to be realized.

The constituents of the electric pipette 100 of the present embodiment externally appearing are specified including the main casing 1, the operation switch 14, the handgrip 15, the display-operation section 9, the release switch 12, the finger rest 18 and charging points 17L, 17R (described later). In the respective surfaces including the front surface 100F, the back surface 100B, a left side surface 100L, a right side surface 100R and an upper surface 100U, lines are drawn between two or more projecting more sites. The respective lines are anticipated to be in contact with a floor when the pipette is dropped.

The bottom surface 100D of the electric pipette 100 acts as the chip holder 7. This portion is long and thin and is hardly in contact with the floor at the time of the dropping. In addition, since the chip holder 7 is usually made of fluorine rein and is elastic and light, the electric pipette 100 is rarely dropped while the bottom surface 100D faces toward the downward direction, and it can be judged that the probability of the breakage is lower. Accordingly, in the present invention, the anticipated lines for the dropping are specified including a front surface line LF, a back surface line LB, a left side surface line LL, a right side surface line LR and an upper surface line LU, and a shock absorber is disposed on at least one apex of at least one line among the above lines. A method of establishing the respective lines and a suitable site on which the shock absorber is disposed will be described in detail taking the electric pipette 100 of the present embodiment as an example. In FIGS. 1 to 4, the shock absorbers are stained.

The base end 1*b* of the main casing 1 of the electric pipette 100 of the present embodiment is rectangularly-shaped such that the display-operation section 9, the electric board 10 and the electric source 12 are effectively stored in the upper part of the main casing 1. Accordingly, after the left end 1Ul and the right end 1Ur of the upper surface 100U of the electric pipette 100 were specified as the projecting sites, the upper surface line LU was drawn. The shock absorbers are preferably formed on the left end 1Ul and the right end 1Ur of the upper surface 100U, which are apexes of the upper surface line LU.

The front surface line LF includes a first front surface line LF1 and a second front surface line LF2. The first front surface line LF1 was drawn between the base end 1*b* of the main casing 1 and the release switch 12 both of which were projecting sites. The second front surface line LF2 was drawn between the release switch 12 and the bottom end of the handgrip 15 both of which were projecting sites. The shock absorbers are preferably disposed on the front end 1Uf of the upper surface 100 of the pipette which is an apex of the first front surface line LF1, on the front end 15*df* of the bottom end 15*d* of the handgrip which is an apex of the second front surface line LF2, and on the top 12*t* of the release switch 12 which is an apex where the first front surface line LF1 and the second front surface line LF2 are crossed.

The back surface line LB includes a first back surface line LB1 and a second back surface line LB2. The first back surface line LB1 was drawn between the base end 1*b* of the main casing and the finger rest 16 both of which were projecting sites. The second back surface line LB2 was drawn between the finger rest 16 and the bottom end 15*d* of the handgrip both of which were projecting sites. The shock absorbers are preferably disposed on the back end 1Ub of the upper surface 100 of the pipette which is an apex of the first back surface line LB1, and on the top 16*t* of the finger rest 16 which is an apex where the first back surface line LB1 and the second back surface line LB2 are crossed. Because of the above reason, the protection of the chip holder 7 may be omitted so that the shock absorber on the front end 7*b* of the chip holder 7 which is an apex of the second front surface line LF2 is not required.

Then, in connection with the right side surface line LR and the left side surface line LL, the electric pipette 100 of the present embodiment employs a rechargeable battery for the electric source 11 of the pipette, and projecting charging points 17L, 17R for electrically conducting the rechargeable battery to an external charging device are mounted on the right side surface 100R and the left side surface 100L of the pipette. Accordingly, if this condition continues, the left and right projecting charging points 17L, 17R inescapably correspond to projecting sites on the left and right side surfaces 100L, 100R, respectively, of the pipette. Therefore, shock absorbers having horizontal heights taller than those of the left and right projecting charging points 17L, 17R are preferably disposed on the peripheral positions of the projecting charging points 17L, 17R on the left and right side surfaces 100L, 100R of the electric pipette 100 (main casing 1). Thereby, the projecting sites shift from the left and right projecting charging points 17L, 17R to the shock absorbers so that the left and right side surface lines LL, LR are never in contact with the left and right projecting charging points 17L, 17R.

Accordingly, the right side surface line LR includes a first right side surface line LR1 and a second right side surface line LR2. The first right side surface line LR1 was drawn between the base end 1*b* of the main casing and the above-mentioned shock absorber both of which were projecting sites. The second right side surface line LR2 was drawn between the above-mentioned shock absorber and the bottom end 15*d* of the handgrip both of which were projecting sites. The shock absorbers are preferably disposed on the right end 1Ur of the upper surface 100U of the pipette, which is an apex of the first right side surface line LR1, and on the right side surface 15*dr* of the bottom end 15*d* of the handgrip, which is an apex of the second right side surface line LR2.

Because of the symmetry of the electric pipette 100 of the present embodiment, the left side surface line LL includes, similarly to the right side surface line LR, a first left side surface line LL1 and a second left side surface line LL2. The first left side surface line LL1 was drawn between the base end 1*b* of the main casing and the above-mentioned shock absorber both of which were projecting sites. The second left side surface line LL2 was drawn between the above-mentioned shock absorber and the bottom end 15*d* of the handgrip both of which were projecting sites. The shock absorbers are preferably disposed on the left end 1Ul of the upper surface 100U of the pipette, which is an apex of the first left side surface line Ll1, and on the left side surface 15*dl* of the bottom end 15*d* of the handgrip which is an apex of the second left side surface line LL2.

The base end 1*b* side of the main casing includes the display-operation section 9, the electric board 10 and the rechargeable battery 11 and is the heaviest part. Therefore, when dropped, the base end 1*b* to which many components are electrically connected is likely to be in contact with a floor so that the base end 1*b* side must be protected at the highest level. Accordingly, the shock absorber is preferably formed on the entire region of the upper surface 100U of the pipette including the above apexes 1Uf, 1Ub, 1Ul, 1Ur.

The lower part of the electric pipette 100 (the front end section 1*t* of the main casing) of the present embodiment is loaded with the detachable soft chip 8. Although this site may be protected because it gets in contact with a floor with high probability when the chip 8 is detached, the protection of the chip holder 7 may be omitted according to the above reasons. Therefore, the shock absorbers are preferably disposed on the entire region (entire outer peripheral region) of the bottom end 15*d* of the handgrip including the above apexes 1Uf, 1Ub, 1Ul, 1Ur because the site to be protected is the bottom end 15*d* of the handgrip.

The shock absorbers are preferably disposed on the upper surface 12*u* of the release switch in addition to the top apex 12*t* of the front surface line LF of the release switch on the upper surface of which is contacted with the thumb of a user.

The shock absorbers are preferably disposed on the lower surface 16*d* in addition to the top 16*t* of the finger rest 16 of which the lower surface is in contact with a user's finger, and the top 16*t* of the finger rest is an apex of the back surface line.

In view of the appropriate positions on which the above shock absorbers are disposed, a shock absorber 201 is disposed on the entire surface of the upper surface 100U of the pipette, a shock absorber 202 is disposed on the outer periphery of the bottom end 15*d* of the handgrip, shock absorbers 203, 204 for the right and left charging points 17L, 17R are disposed on the right and left side surfaces 100L, 100R of the pipette, a shock absorber 205 is disposed on the top 12*t* of the release switch and the upper surface 12*u* of the release switch, and a shock absorber 206 is disposed on the top 16*t* of the finger rest and the lower surface 16*d* of the finger rest.

The material of the shock absorbers 201 to 206 is preferably made of synthetic resin which is soft and properly elastic, such as silicone resin, fluorine rubber and urethane resin.

The shock absorbers 201 to 206 are disposed on the above positions by integrally molding the absorber with the main casing 1 made of resin material such as fluorine resin, or by using other various means such fitting and pasting to the main casing 1. One example thereof will be described by employing the configuration of the present embodiment.

The shock absorber 201 disposed on the upper surface 100U of the pipette is disposed in shape of cover for covering the entire surface of the upper surface 100U and the side surface (outer periphery) of the base section 1*b* of the main casing, and is fitted by engaging an engaging boss formed on the back surface of the shock absorber 201 to an engaging aperture formed on the upper surface of the main casing 1 in a concave-convex manner.

The shock absorbers 203, 204 disposed on the left side surface 100L and the right side surface 100R of the pipette are semispherically formed such that their radii are taller than the heights of the right and left charging points 17L, 17R, and are stuck immediately above the charging points 17L, 17R The shock absorber 202 disposed at the bottom end 15*d* of the handgrip is splayed out in a shape of circle such that its front surface line LF, left side surface line LL and right side surface line LR are not in contact with the chip holder 7, and a hollow part which is open toward the above and peripherally formed of the shock absorber 202 is pushed into the bottom end 15*d* of handgrip. Thereby, the engaging concave portion peripherally formed of the hollow part is disposed to the engaging convex portion peripherally formed of the bottom end 15*d* of the handgrip in a concave-convex manner by means of embedding.

The shock absorber 205 disposed on the release switch 12 has a vertical cross section in a shape of nearly a rectangular triangle, and includes a downward dropped section 205*t* at its acute angle part. The downward dropped section 205*t* for protecting the top 12*t* of the release switch and its hypotenuse 205*u* for protecting the upper surface 12*u* of the release switch are integrally molded (refer to FIG. 2). An engaging boss formed on the back surface of the shock absorber 205 is pushed into an engaging aperture formed on the release switch 12 such that the shock absorber 205 is squeezed from above so that these are engaged with each other in a concave-convex manner.

The shock absorber 206 disposed on the finger rest 16 is formed in an arc shape which follows the finger rest 16, and includes a first engaging boss 2061 for protecting the top 16*t* of the finger rest at one end and a second engaging boss 2062 for at the other end, which are integrally molded for protecting the top 16*t* of the finger rest and the bottom surface 16*d* of the finger rest (refer to FIG. 2). The first engaging boss 2061 and the second engaging boss 2062 of the shock absorber 206 are disposed to the finger rest 16 by pushing the bosses 2061, 2062 into first and second engaging apertures formed on the finger rest 16 such that the shock absorber 206 is squeezed from the lower side in a concave-convex manner.

Of course, the shock absorbers 205, 206 may be separately disposed to the respective protection positions, not in the shape of the integral molding.

As described above, in accordance with the present embodiment, the shock of the dropping of articles can be reduced, or the external destruction of the electric pipette 100 and the damage of the operation environment can be reduced by disposing the shock absorbers 201 to 206 at the apexes (1Ul, 1*ur*, 1Uf, 1Ub, 12*t*, 15*df*, 15*dr*, 16*t*) on the dropping predicted lines (the upper surface line LU, the front surface line LF, the back surface line LB, the left side surface line LL and the right side surface line LR) which are anticipated to be in contact with the floor when the electric pipette 100 is dropped.

The impact resistance is further elevated by disposing the shock absorbers 201, 202 on the entire regions (entire peripheral regions) of the upper surface 100U of the pipette most properly protected and of the bottom end 15*d* of the handgrip which is to be protected when the chip 8 is detached.

With respect to the charging points 17L, 17R which are required to have breakage prevention, the breakage thereof can be prevented and the impact resistance is further elevated by disposing the shock absorbers 203, 204 which are taller than the charging points 17L, 17R on the left side surface 100L and the right side surface 100R of the pipette.

As described above, the units such as the motor in the electric pipette 100 and the electric board 10 for controlling the motor which are easily damaged due to the impact can be also protected so that the discharging function of the pipette can be secured and maintained, and the device reliability is also increased.

The anti-slip effect of a finger and the operating ability increased by the fitting comfort can be elevated by disposing the shock absorbers 205, 206 on the apexes 12*t*, 16*t* of the front surface line LF and the back surface line LB of the release switch 12 and the finger rest 16 and, in addition, on the upper surface 100U of the release switch and the lower surface 16*d* of the finger rest.

Although, in the present embodiment, the shock absorbers are disposed on all of the dropping predicted lines including the upper surface line LU, the front surface line LF, the back surface line LB, the left side surface line LL and the right side surface line LR, the shock absorbers may be disposed on one or more lines which are recognized to be important as a result of a dropping test of the designed electric pipette.

DESCRIPTION OF SYMBOLS

1 . . . main casing
l*b* . . . base section of main casing
1*t* . . . top section of main casing
2 . . . cylinder
3 . . . piston
4 . . . liquid sucking and discharging mechanism
8 . . . chip
9 . . . display-operation section
12 . . . release switch
12*t* . . . top of release switch
12*u* . . . upper surface of release switch
14 . . . operation switch
15 . . . handgrip
15*d* . . . bottom end of handgrip
15*df*, 15*dl*, 15*dr* . . . apex
16 . . . finger rest
16*d* . . . bottom surface of finger rest
16*t* . . . top of finger rest
17L, 17R . . . charging point
100F . . . front surface of pipette
100B . . . back surface of pipette
100L . . . left side surface of pipette
100R . . . right side surface of pipette
100U . . . upper surface of pipette
1Ul, 1Ur, 1Jf, 1Ub . . . apex
LF . . . front surface line
LB . . . back surface line
LL . . . left side surface line
LR . . . right side surface line
LU . . . upper surface line

The invention claimed is:

1. An electric pipette comprising:

a vertically cylindrical main casing including a liquid sucking and discharging mechanism for sucking and discharging a liquid by vertically moving a piston in a cylinder, and a chip which is detachably positioned on a front end of the mechanism constituting a lower side, and is in communication with the mechanism;

an operation switch for activating the mechanism;

a hand grip of the main casing which is gripped when the operation switch is operated;

a display-operation section for establishing a sucking and discharging movement;

a release switch for detaching the chip;

a finger rest acting as a support assistance during an operation and as a stopper during a non-operation; and a shock absorber mounted on the main casing, release switch and finger rest and disposed only at a corner and/or a convex portion of at least one line among a front surface line, a back surface line, a left side surface line, a right side surface line and an upper surface line, which are prepared by drawing lines between two or more projecting sites in each of a front surface, a back surface, a left side surface, a right side surface and an upper surface appearing on an external shape of the electric pipette designed to include above constituents, wherein the shock absorber is made of a material that is soft and elastic and that is different from material forming the cylindrical main casing, and wherein the operation switch and all other components of the electric pipette are contained within said lines.

2. The electric pipette as claimed in claim 1, wherein the display-operation section is designed to exist on a base section of the main casing, and the shock absorber is disposed on the upper surface of the electric pipette.

3. The electric pipette as claimed in claim 1, wherein the shock absorber is disposed on an outer periphery of a bottom end of the handgrip.

4. The electric pipette as claimed in claim 1, wherein the display-operation section is designed to exist on the front surface of the electric pipette, the release switch is designed to exist on the front surface of the electric pipette, and the shock absorber is disposed on an upper surface of the release switch.

5. The electric pipette as claimed in claim 1, wherein the display-operation section is designed to exist on the front surface of the electric pipette, the finger rest is designed to exist on the back surface of the pipette, and the shock absorber is disposed on a bottom surface of the finger rest.

6. An electric pipette comprising:

a vertically cylindrical main casing including a liquid sucking and discharging mechanism for sucking and discharging a liquid by vertically moving a piston in a cylinder, and a chip which is detachably positioned on a front end of the mechanism constituting a lower side, and is in communication with the mechanism;

an operation switch for activating the mechanism;

a hand grip of the main casing which is gripped when the operation switch is operated;

a display-operation section for establishing a sucking and discharging movement;

a release switch for detaching the chip;

a finger rest acting as a support assistance during an operation and as a stopper during a non-operation; and a shock absorber disposed solely on at least one apex of at least one line among a front surface line, a back surface line, a left side surface line, a right side surface line and an upper surface line, which are prepared by drawing lines between two or more projecting sites in each of a front surface, a back surface, a left side surface, a right side surface and an upper surface appearing on an external shape of the electric pipette designed to include above constituents, wherein the shock absorber is made of a material that is soft and elastic and that is different from material forming the cylindrical main casing, wherein projecting charging points positioned on the left and right side surfaces, which are in electrical communication with a rechargeable battery stored in the main casing, are formed and the shock absorbers are disposed on the left and right side surfaces, which exist more externally than the charging points in a horizontal direction.

* * * * *